US006050923A

United States Patent [19]

Yu

[11] Patent Number: 6,050,923

[45] Date of Patent: Apr. 18, 2000

[54] FOLDABLE JOGGING MACHINE HAVING A JOGGING PLATFORM ADJUSTABLE FOR DOING UPHILL JOGGING

[75] Inventor: Jessica Yu, Taoyuan Hsien, Taiwan

[73] Assignee: Healthstream International Inc., Taoyuan Hsien, Taiwan

[21] Appl. No.: 09/266,933

[22] Filed: Mar. 12, 1999

[51] Int. Cl.[7] ..... A63B 21/00

[52] U.S. Cl. ..... 482/54; 482/51

[58] Field of Search ..... 482/51, 54

[56] References Cited

U.S. PATENT DOCUMENTS 5,683,332 11/1997 Waterson et al. ..... 482/54

5,718,657 2/1998 Dalebout et al. ..... 482/54

*Primary Examiner*—Glenn E. Richmon

*Attorney, Agent, or Firm*—Browdy and Neimark

[57] ABSTRACT

A foldable jogging machine comprises a support body, a jogging platform, a connection member, a linear actuating device, and a lifting member. The support body is formed of a base and a support frame. The jogging platform has a front side, a rear side, a left side and a right side. The front side is provided with a receiving slot in which a first motor is mounted for driving a track located between the left side and the right side. The rear side is provided with at least one roller in contact with the floor surface. The base of the support body is fastened pivotally with the front side of the jogging platform by the connection member such that the jogging platform can be moved between a first position and a second position in relation to the base. The linear actuating device comprises a second motor mounted in the receiving slot, and an expandable rod driven by the second motor. The lifting member has a load portion, a force application portion, and two pivoting portions located between the load portion and the force application portion. The pivoting portions are pivoted with the receiving slot. The load portion is connected with the expandable rod. The force application portion is provided with at least one roller. The lifting member is actuated to swivel to elevate the front side of the jogging platform at the time when the platform is located at the first position and when the expandable rod is extracted. The track is thus sloped. When the platform is located at the second position, the roller of the force application portion is in contact with the floor surface to give a support to the platform held in a folded position.

3 Claims, 4 Drawing Sheets

FRIOR ART

FOLDABLE JOGGING MACHINE HAVING A JOGGING PLATFORM ADJUSTABLE FOR DOING UPHILL JOGGING

FIELD OF THE INVENTION

The present invention relates generally to a jogging machine, and more particularly to a jogging machine which is foldable and can be used for doing a horizontal jogging exercise or an uphill jogging exercise.

BACKGROUND OF THE INVENTION

As shown in FIG. 1, an electrically-driven jogging machine 10 of the prior art comprises a frame 11 and a jogging platform 12. The frame 11 is formed of a base 11*a* and two support rods 11*b* extending uprightly from the base 11*a*. A control device 11*c* is mounted on the top ends of the two support rods 11*b*. The jogging platform 12 has a front side 12*a* which is mounted pivotally on two rotary shafts 12*b* which are fastened with the support rods 11*b*. The jogging platform 12 is provided in the underside thereof with two legs 12*c* making contact with the floor surface. The jogging platform 12 is provided between a left longitudinal side 12*e* thereof and a right longitudinal side 12*f* thereof with a track 12*g* on which an exerciser is engaged in a trotting motion imitative of jogging. The jogging machine 10 can be folded such that the rear end 12*i* of the jogging platform 12 is raised to rest against the support rods 11*b*.

In order to prevent the interference between the frame 11 and the jogging platform 12 at the time when the jogging platform 12 is turned in relation to the frame 11 so as to fold the jogging machine 10, the rotary shafts 12*b* are located over the floor surface by a distance H which is greater than a distane S between the rotary shafts 12*b* and the edge of the front side 12*a* of the jogging platform 12. As a result, the track 12*g* is slanted in relation to the floor surface at the time when the jogging machine 10 is in a normal operating state, as shown in FIG. 1. In the event that an exerciser wants to do a horizontal jogging, the legs 12*c* of the jogging platform 12 must be so adjusted as to be flush with the rotary shafts 12*b*. As a result of the adjustment of the legs 12*c*, the center of gravity of the prior art jogging machine 10 is so raised as to undermine the stability of the machine 10 in operation. In addition, the adjustment of the legs 12*c* is done manually.

SUMMARY OF THE INVENTION

The primary objective of the present invention is to provide a foldable jogging machine capable of operating stably at the time when it is used for doing a horizontal jogging exercise.

It is another objective of the present invention to provide a foldable jogging machine which is provided with a jogging platform adjustable easily in inclination thereof in relation to a floor surface on which the jogging machine is rested.

In keeping with the principle of the present invention, the foregoing objectives of the present invention are attained by a foldable jogging machine comprising a support body, a jogging platform, a connection member, a linear actuating device, and a lifting member. The support body is formed of a base and a support frame. The jogging platform has a front side, a rear side, a left side and a right side. The front side is provided with a receiving slot in which a first motor is mounted for driving a track located between the left side and the right side. The rear side is provided with at least one roller in contact with the floor surface. The base of the support body is fastened pivotally with the front side of the jogging platform by the connection member such that the jogging platform can be displaced between a first position and a second position in relation to the base. The linear actuating device comprises a second motor and an expandable rod. The second motor is located in the receiving slot for driving the expandable rod to extract or retract. The lifting member has a load portion, two pivoting portions and a force application portion. The pivoting portions are pivoted with the receiving slot. The load portion is connected with the expandable rod. The force application portion is provided with at least one rolling wheel. The lifting member is actuated to swivel to raise the front side of the jogging platform at the time when the jogging platform is located at the first position and the expandable rod is extracted. As a result, the track is slanted. When the jogging platform is located at the second position, the rolling wheel of the force application portion is in contact with the floor surface to give an added support to the jogging platform.

The foregoing objectives, features, functions, and advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
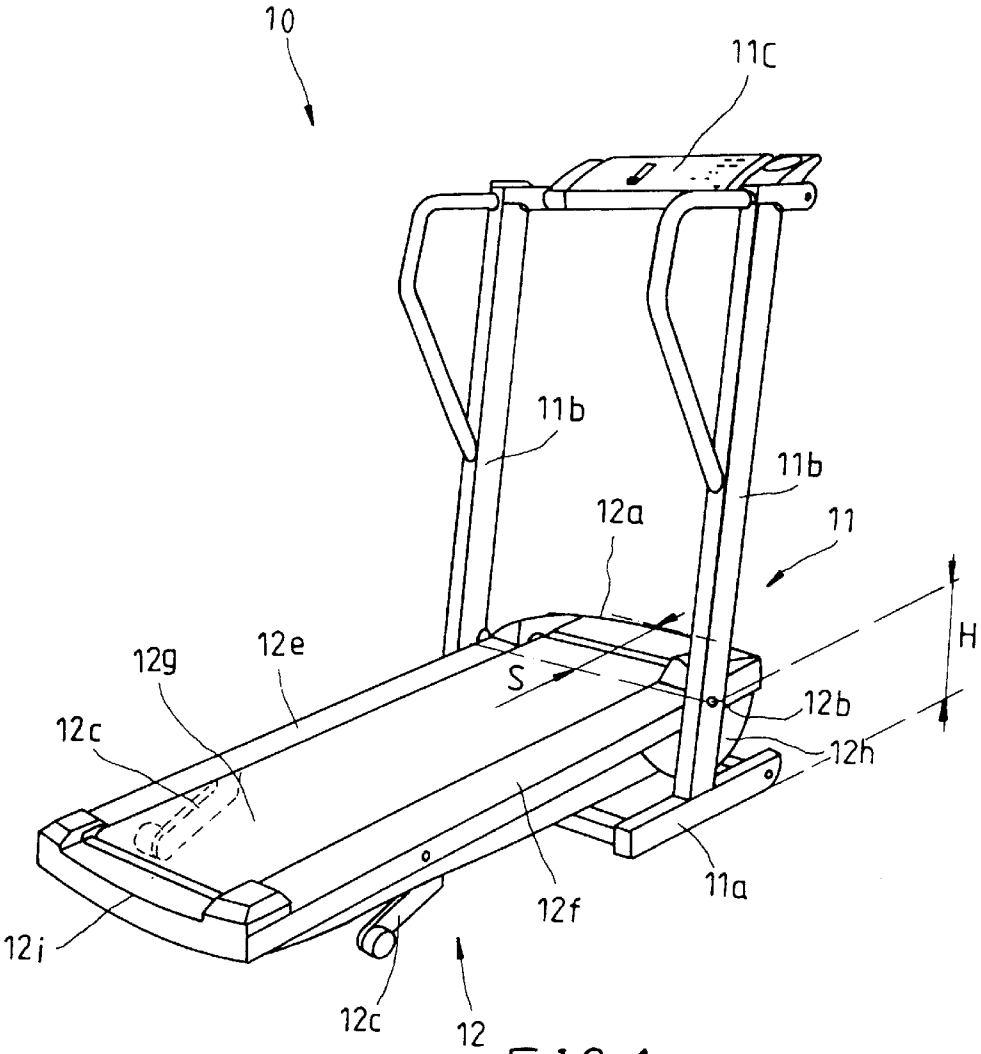
FIG. 1 shows a perspective view of a jogging machine of the prior art.
Figure 2:
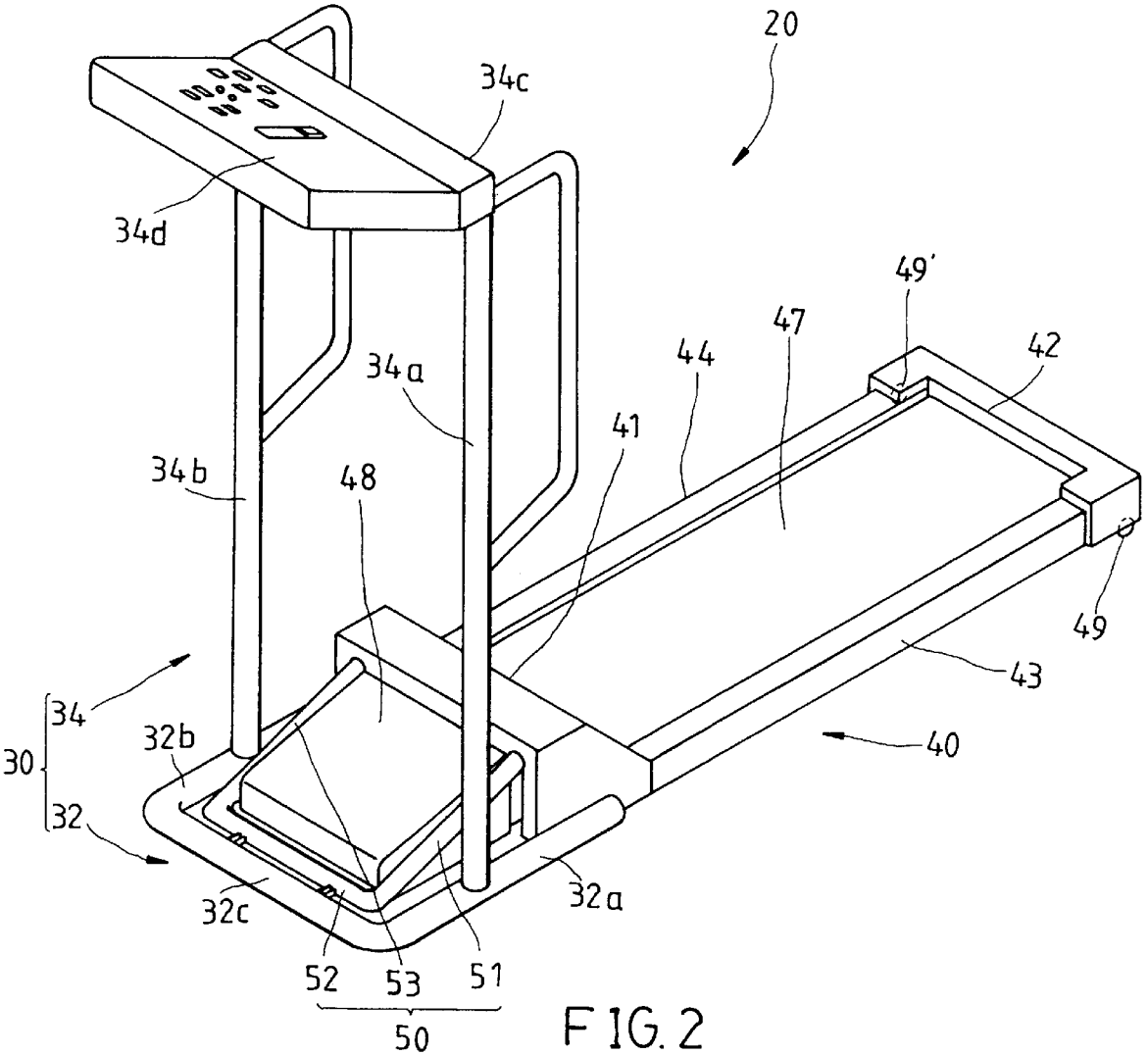
FIG. 2 shows a perspective view of the preferred embodiment of the present invention in use for doing a horizontal jogging exercise.
Figure 3:
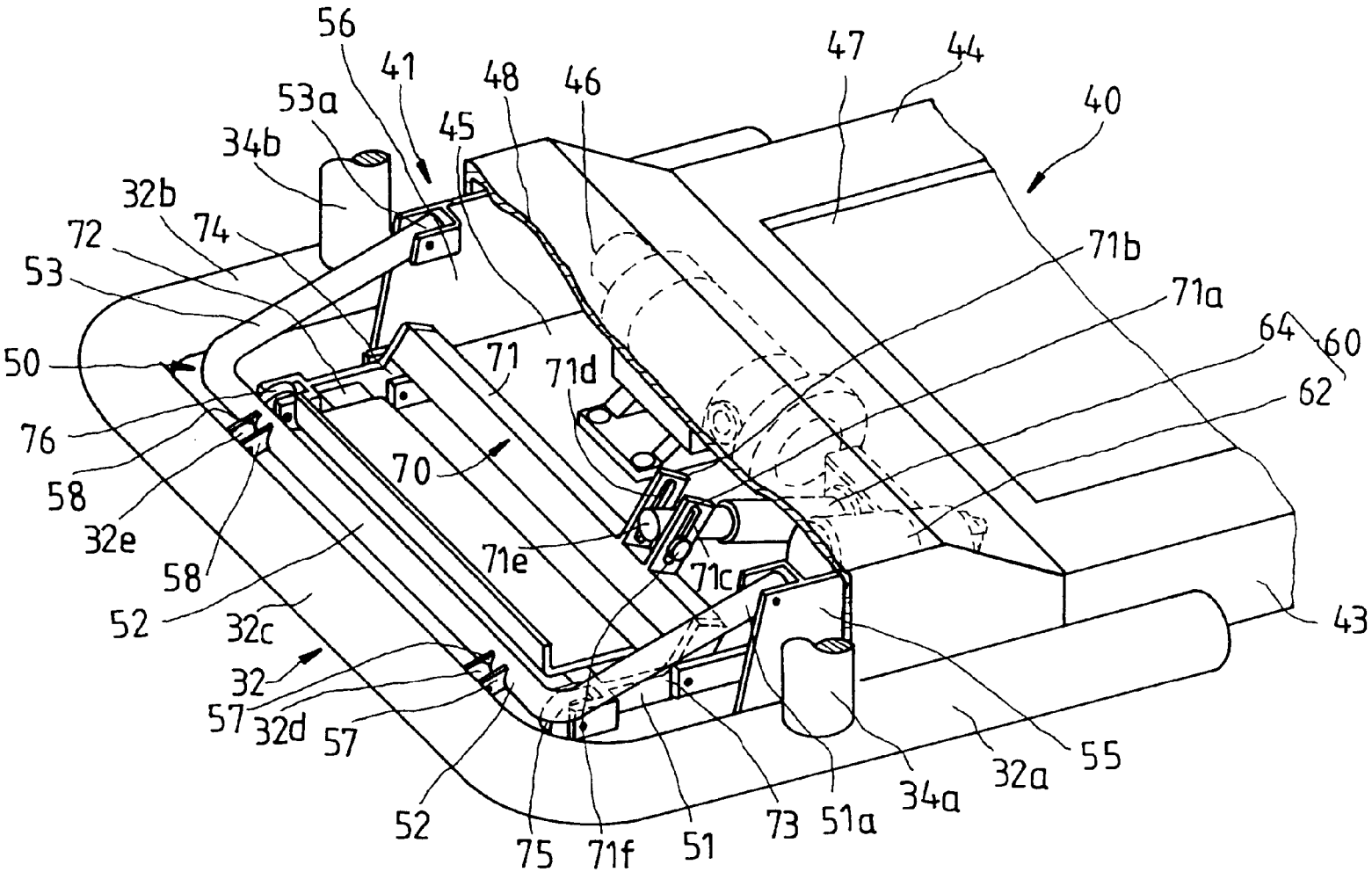
FIG. 3 shows a partial perspective view of the preferred embodiment of the present invention in use for doing a horizontal jogging exercise.

As shown in FIGS. 2 and 3, a foldable jogging machine 20 of the preferred embodiment of the present invention is composed of the component parts which are described hereinafter.

A support body 30 is formed of a base 32 and a support frame 34. The base 32 is of an inverted U-shaped construction and is composed of a first rod member 32*a*, a second rod member 32*b*, and a first cross rod 32*c*, which are connected by welding. The base 32 is rested on the floor surface. The first cross rod 32*c* is provided with two pivoting lugs 32*d* and 32*e* which are fastened therewith by welding. The support frame 34 is composed of a third rod member 34*a*, a fourth rod member 34*b*, and a second cross rod 34*c*, which are fastened by welding such that the bottom ends of the third rod member 34*a* and the fourth rod member 34*b* are fastened respectively with the first rod member 32*a* and the second rod member 32*b* by welding. The support frame 34 is uprightly fastened with the base 32. A control device 34*d* is mounted securely on the second cross rod 34*c*.

A jogging platform 40 has a front side 41, a rear side 42, a left side 43, and a right side 44. The front side 41 is provided with a receiving slot 45 in which a first motor 46 is located such that the first motor 46 is electrically connected with the control device 34*d*. A track 47 is disposed between the left side 43 and the right side 44 such that the track 47 is driven by the first motor 46 to move along a closed path so as to enable an exerciser to engage in a trotting motion imitative of jogging. The front side 41 is provided on the top thereof with a cover 48 for shielding the receiving slot 45. The rear side 42 is provided in the underside thereof with two rollers 49 and 49' fastened therewith.

A connection member 50 has a first section 51, a second section 52, and a third section 53. The first and the third sections 51 and 53 are parallel to each other. The second section 52 is connected with and perpendicular to the first section 51 and the third section 53. The first section 51 has one end 51*a*, whereas the third section 53 has one end 53*a*. Both ends 51*a* and 53*a* are coaxially pivoted with a left side wall 55 and a right side wall 56 of the receiving slot 45. The second section 52 is provided with two sets of pivoting lugs 57 and 58, which are coaxially pivoted with the two pivoting lugs 32*d* and 32*e* of the first cross rod 32*c*.

A linear actuating device 60 is located in the receiving slot 45 and is composed of a second motor 62 and an expandable rod 64. The second motor 62 is electrically connected with the control device 34*d*. The expandable rod 64 is driven by the second motor 62 to extract or retract.

A lifting member 70 is of a rectangular frame and is provided with a load portion 71, a force application portion 72, and two pivoting portions 73 and 74 which are located between the load portion 71 and the force application portion 72. The two pivoting portions 73 and 74 are coaxially pivoted with the bottom of the receiving slot 45. The load portion 71 is provided thereon with two connection pieces 71*a* and 71*b* which are parallel to each other and fastened with the load portion 71. The two connection pieces 71*a* and 71*b* are provided respectively with a hole 71*c*, 71*d*. The expandable rod 64 has a free end 71*e* which is located between the two connection pieces 71*a* and 71*b*. The expandable rod 64 is fastened pivotally with the load portion 71 by a pivot 71*f* which is put through the holes 71*c*, 7 1*d*, and the free end 71 e of the expandable rod 64. The force application portion 72 is provided with two rollers 75 and 76 fastened pivotally therewith. When the jogging machine 20 is used for doing a horizontal jogging exercise, the two rollers 75 and 76 remain a distance from the floor surface, as shown in FIG. 3.

As shown in FIGS. 2 and 3, when the machine 20 is used for doing the horizontal jogging exercise, the jogging platform 40 is almost in contact with the floor surface in its entirety such that the jogging platform 40 is connected with the support body 30 by the connection member 50. The relationship between the speed and the time of the first motor 46 is set up by the control device 34*d*. A trotting motion imitative of the jogging exercise is brought about by moving both legs on the track 47 in motion. In light of the jogging platform 40 being almost in contact with the floor surface, the center of gravity of the jogging machine 20 of the present invention is considerably low to enhance the operational stability of the machine 20.

The jogging machine 20 of the present invention is folded by lifting the rear side 42 of the jogging platform 40 such that the jogging platform 40 is moved to join with the support frame 34 of the support body 30, thereby causing the front side 41 of the platform 40 to turn in relation to the support body 30 on the pivoting point of the connection member 50 serving as a fulcrum. In the meantime, the two rollers 75 and 76 of the force application portion 72 of the lifting member 70 are in contact with the floor surface to give a support to the platform 40, which is thus located uprightly, as shown in FIG. 4.

Figure 4:
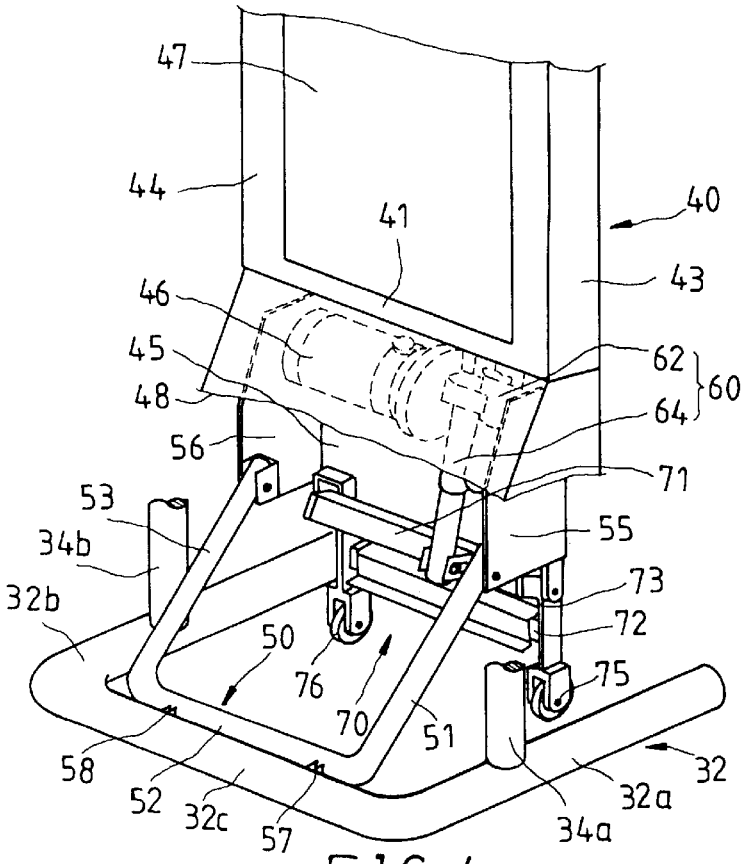
FIG. 4 shows a partial perspective view of the preferred embodiment of the present invention in the folded state.

The jogging platform 40 is capable of moving between a first position, as shown in FIG. 3, and a second position, as shown in FIG. 4, in relation to the support body 30. The first position takes place at the time when the jogging platform 40 is almost parallel to the floor surface. The second position takes place at the time when the jogging platform 40 is located uprightly to join with the support frame 34 of the support body 30.

Figure 5:
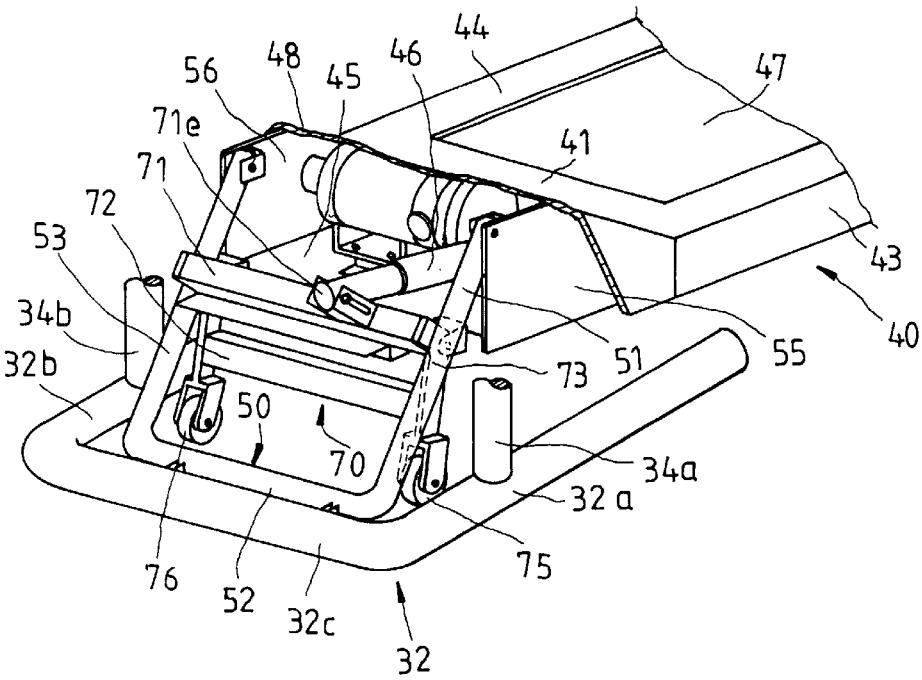
FIG. 5 shows a partial perspective view of the preferred embodiment of the present invention in use such that the track is slanted.

The jogging machine 20 of the present invention can be used to do an uphill jogging exercise. As shown in FIG. 5, the second motor 62 of the linear actuating device 60 is controlled by the control device 34*d* such that the expandable rod 64 is driven by the second motor 62 to extract to press the load portion 71 of the lifting member 70, thereby forcing the lifting member 70 to turn on the pivoting points of the two pivoting portions 73 and 74. As a result, the two rollers 75 and 76 of the force application portion 72 of the lifting member 70 are in contact with the floor surface such that the front side 41 of the jogging platform 40 is elevated and that the track 47 is thus sloped to facilitate the uphill trotting. The sloped platform 40 can be reverted to the horizontal position parallel to the floor surface by retracting the expandable rod 64 to cause the lifting member 70 to turn in reverse.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A jogging machine comprising:

a support body formed of a base in contact with a floor surface, and a support frame extending uprightly from said base;

a jogging platform having a front side, a rear side, a left side, and a right side, said front side provided with a receiving slot and a first motor mounted in said receiving slot, said platform provided with a track located between said left side and said right side such that said track is driven by said first motor to move along a closed path, said rear side provided with at least one roller fastened therewith;

a connection member fastening pivotally said base with said front side of said platform such that said platform moves between a first position and a second position in relation to said base, and that said platform is parallel to the floor surface at the time when said platform is located at said first position, and further that said rear side of said platform is joined with said support frame of said support body at the time when said platform is located at said second position;

a linear actuating device comprising a second motor mounted in said receiving slot, and an expandable rod driven by said second motor to extract or retract; and a lifting member having a load portion, a force application portion, and two pivoting portions located between said load portion and said force application portion such that said pivoting portions are pivoted in said receiving slot, said load portion being connected with said expandable rod, said force application portion being provided with at least one roller, whereby said lifting member is actuated to swivel on said pivoting portions to cause said roller of said force application portion to be in contact with the floor surface at such time when said platform is located at said first position and when said expandable rod is extracted, thereby causing said front side of said platform to be elevated such that said track is thus sloped, and whereby said roller of said force application portion of said lifting member is in contact with the floor surface to give a support to said platform at the time when said platform is located at said second position.

2. The jogging machine as defined in claim 1, wherein said connection member has a first section, a second section, and a third section parallel to said first section, said second section connecting said first section and said third section such that said second section is perpendicular to said first section and said third section, said first section and said third section being coaxially pivoted with two opposite side walls of said receiving slot, said second section being pivoted with said base.

3. The jogging machine as defined in claim 1, wherein said load portion has two connection pieces each having a hole; and wherein said expandable rod is located between said two connection pieces such that said expandable rod is fastened pivotally with said load portion of said lifting member by a pivot which is put through said holes of said two connection pieces and said expandable rod.

* * * * *